US005083956A

United States Patent [19]

Chraghchian et al.

[11] Patent Number: 5,083,956

[45] Date of Patent: Jan. 28, 1992

[54] WATER WARNING DEVICE

[75] Inventors: Pierre Chraghchian, Encino, Calif.; Norik Alexandrian, 343 Pioneer Dr. #401, Calif. 91203

[73] Assignee: Norik Alexandrian, Calif.

[21] Appl. No.: 653,336

[22] Filed: Feb. 11, 1991

[51] Int. Cl.[5] ..... B63C 9/08

[52] U.S. Cl. ..... 441/89; 116/209; 441/80

[58] Field of Search ..... 441/89, 80; 114/253; 116/173, 209, 174, 228, 107, 110, 323

[56] References Cited

U.S. PATENT DOCUMENTS

| | | | |
|---|---|---|---|
| 3,122,736 | 2/1964 | Weber | 441/89 X |
| 4,035,856 | 7/1977 | Oberg | 441/89 |
| 4,598,661 | 7/1986 | Roe | 441/89 X |
| 4,757,305 | 7/1988 | Peso | 116/110 |
| 5,029,551 | 7/1991 | Rosen | 116/209 |

*Primary Examiner*—Ed Swinehart
*Attorney, Agent, or Firm*—Julius Rubinstein

[57] ABSTRACT

A self elevating signalling device for water skiers makes them more visible if and when they fall off their skies into the water. The device comprises an enlarged visual luminescent marker comprising an outer guide tube and a buoyant tube freely mounted inside the guide tube secured to a flotation jacket and positioned in a vertical position when the fallen skier is in the water. The guide tube has an opening formed therein below the surface of the water permitting the guide tube to fill with water causing the buoyant tube to rise inside the guide tube. The length of the buoyant tube is such that the water inside the guide tube lifts the buoyant tube above the head of the person wearing the flotation jacket enabling rescuers to locate him.

7 Claims, 1 Drawing Sheet

WATER WARNING DEVICE

This invention relates to a warning device, and more particularly to a device for readily detecting the position of persons have fallen into the water while engaged in water skiing to prevent these persons from being struck by any powered vessel.

BACKGROUND AND BRIEF SUMMARY OF INVENTION

Heretofore, many devices have been developed for locating persons who fall in the water while water skiing so that high speed ski tow boats can see them in time to avoid striking them. Some of the prior devices of this kind are exemplified by the patents to Weber U.S. Pat. No. 3,122,736, Wainright U.S. Pat. No. 3,872,529, Roe U.S. Pat. No. 4,598,661, and Melendez U.S. Pat. No. 4,752,264.

The patent to Weber discloses a warning device 65 mounted on one end of a mast 57. The opposite end of the mast is attached to a metal water tight flotation tank 45. When the skier or swimmer falls into the water the flotation tank rises on guide rods 32 and 38 raising the mast and the warning device 65 above the head of person in the water so he will be visible to other boaters or surfers. The objection to the Weber approach is that the flotation device can spring a small leak and lose its buoyancy. In addition the device is expensive to make because it requires welding and electrical wiring, all of which could fail at a critical moment.

The patent to Wainright discloses a swimmer with a belt strapped around his waist and with a rod or mast 34 extending upwards terminating in a signalling device or flag 42.

The patent to Roe, discloses a telescoping mast terminating in a signalling device mounted on a floatation device. When a swimmer falls in the water, he pulls a knob 19 which raises the telescoping mast with a flag on top so the signalling device will be more visible. However an objection to the Roe device is that corrosion could make the device inoperable. Moreover the telescoping mast must be treated gently or else it could bend and jam when the skier falls into the water. But water skiing is a vigorous sport, and when the skier falls substantial pressure is exerted on the mast which is not compatible with the requirement that the telescoping mast be treated gently. In addition erection of the mast requires a conscious act of the person on the skis because the person has to pull the knob portion 19. If as a result of the fall, the person become unconscious, he would be unable to pull the knob 19 activating the signalling device.

The patent to Melendez discloses a mast terminating at one end to a warning flag 24 and attached at the other end to a flotation device worn by a swimmer.

In contrast, in the present invention, an elongated hollow tube formed from a buoyant plastic material is mounted inside a generally cylindrical guide tube. The hollow tube terminates in a brightly colored signalling device which enhances the visibility of the person in the water. When the person water skiing falls in the water the signally device when immersed in the water will lift the elongated tube upward above the head of the person in the water thus making the person more visible to persons driving motor operated vessels. It is important to note that the elongated hollow tube will elevate automatically because of its buoyancy, thus in the event falls into the water becomes unconscious, the signalling device attached to the life jackets of water skiers will activate without any effort on his part.

What is needed therefore, and comprises an important object of this invention is to provide a signalling device easily attached to the life jacket of water skiers, which has a buoyant marker device which raises automatically when immersed in the water.

Another important object of this invention is to provide a retractable buoyant floatation signaling device which automatically elevates itself above the head of the person wearing the device when the person falls into the water.

These and other objects of this invention will become more apparent when better understood in the light of the accompanying specification and drawings wherein.

Figure 1:
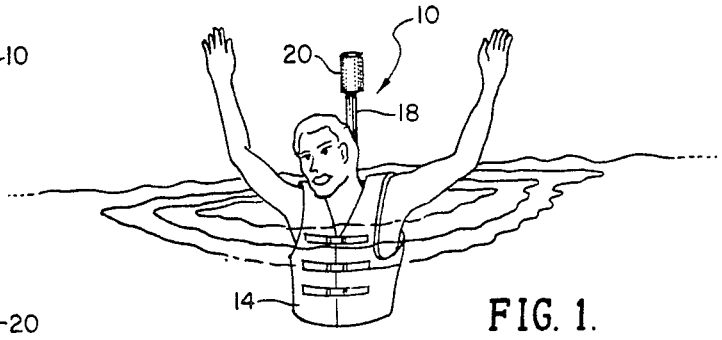
FIG. 1 is a perspective view of a swimmer in the water showing the signaling device in an erect position to warn other boaters of his presence.

Referring now to FIG. 1 of the drawing the signaling device indicated generally by the reference numeral 10, comprises a support member 12 which is adapted to be secured to a floatation life jacket 14. The support member 12 has a guide tube 16 rigidly attached thereon. A buoyant tube 18 hollow tube 18 is slidably mounted inside the guide tube 16.

The buoyant tube 18 is formed from a suitable buoyant material and terminates in a signal head 20. The signal head and the buoyant tube are brightly painted to make them more visible. The tube 18 is confined within the guide tube 16 for reasons to become apparent below.

To secure the support member to the flotation jacket 14, four screws 21, extend from the outer surface 22 of the flotation jacket 14 (shown in phantom lines) to the front surface 24. These screws terminate in circular heads 26 on which cushioned pads 28 are cemented for comfort when worn by water skiers.

The buoyant tube 18 is slidably mounted inside the guide tube 16. However to prevent the buoyant tube from rising out of the top of the guide tube 16, a stop collar 30 is formed inside the inner surface 32 of the guide tub. In addition, the base of the buoyant tube 18 is provided with a generally cylindrical plug-like closure 34 which has an outside diameter greater than the inside diameter of the stop collar 30. With this arrangement since the diameter of the closure 34 is greater than the inside diameter of the stop collar 30, the buoyant tube 18 cannot float or be pulled out of the top of the guide tube 16.

An end cap 36 is secured to the to the lower end 38 of the guide tube 16. This cap has a opening 40 extending therethrough for reasons to become apparent below.

The upper edge 42 of the guide tube 16 has a gently curved flange 42 which in the embodiment shown is circular in cross section. This flange is important because if the water skier falls off his skies into the water while being towed at high speeds, he is apt to tumble over the surface of the water. Since a portion of the guide tube extends above the circular flange, this tumbling of the skier, could cause the water to push the guide tube in various directions, so that the part of the guide tube extending above the curved flange strikes various parts of the curved flange. But since the curve has a comparatively large radius of curvature, the area of impact is increased decreasing the force of the blow so that the guide tube will not break. In contrast, if the top edge of the guide tube simply terminated in a circular opening, the flotation tube would strike the sharp edge of the guide tube and the force of the water on the floatation tube could break it.

Another advantage in providing the upper edge of the guide tube with a curved flange, is that the curved flange guides the flotation tube back into the guide tube when the skier gets back out of the water onto his skis out of the region below the signal head so the pressure of the water cannot damage the signal head and the floatation tube. In addition when the vessel towing the skier in the water accelerates and if the guide tube had no flange, the force of the water and the wind could cause a portion of the flotation tube to strike the upper edge of the guide tube hard enough so that the floatation tube does not retract back into the guide tube when the skier is upright.

It is noted that the bottom surface 48 of the end cap 36 at the lower end of the guide tube 16 is not perpendicular to the back surface 22 of the floatation jacket 14. As seen it is angular downward to provide clearance between the back surface 22 of the flotation jacket 14 and the bottom 48 of the guide tube 14. This minimizes the possibility for injury in the event a water skier tumbles backward into the water and also prevents the lower edge of the guide tube from piercing the life jacket.

In operation, when a water skier falls into the water, the signalling device 10 is immersed and water enters the opening 40 in the cap 36 and fills the space between the end of the buoyant tube 18 and the inner surface of the guide tube 16. Since the buoyant tube 18 is hollow it rises inside the guide tube 16 to the position shown in FIG. 1 where it becomes more visible to other motor boats in the area.

The comparatively small size of the opening 40 in the end cap 36 restricts the water from rushing into the guide tube 16 too fast, thus preventing a premature extension of the buoyant tube to avoid subjecting the buoyant tube to breaking by the shock of its impact with the water.

Figure 2:
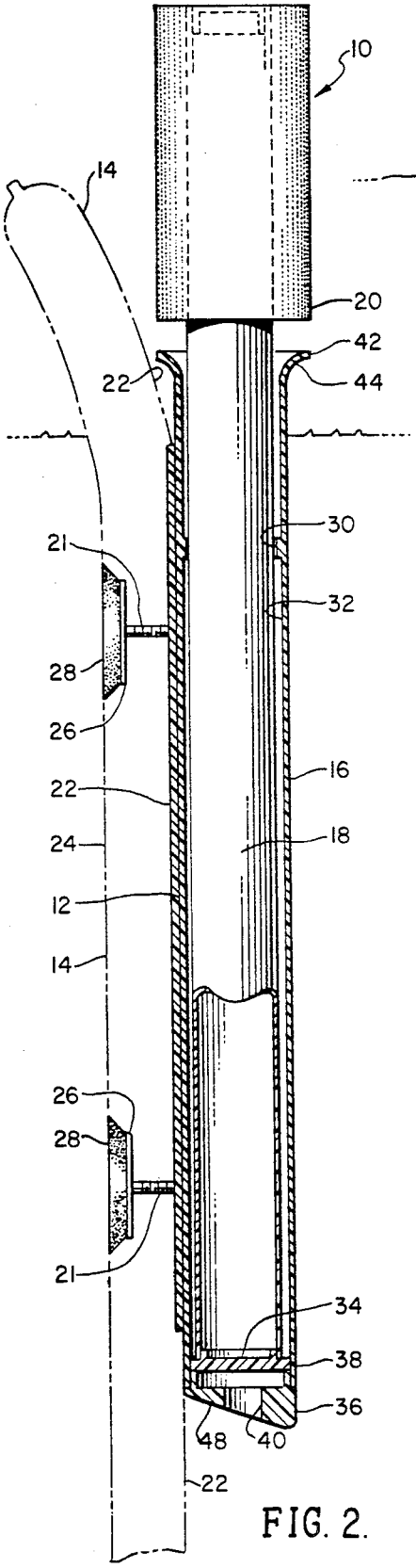
FIG. 2 is an elevational view partly in section showing the signalling device in a retracted position.
Figure 3:
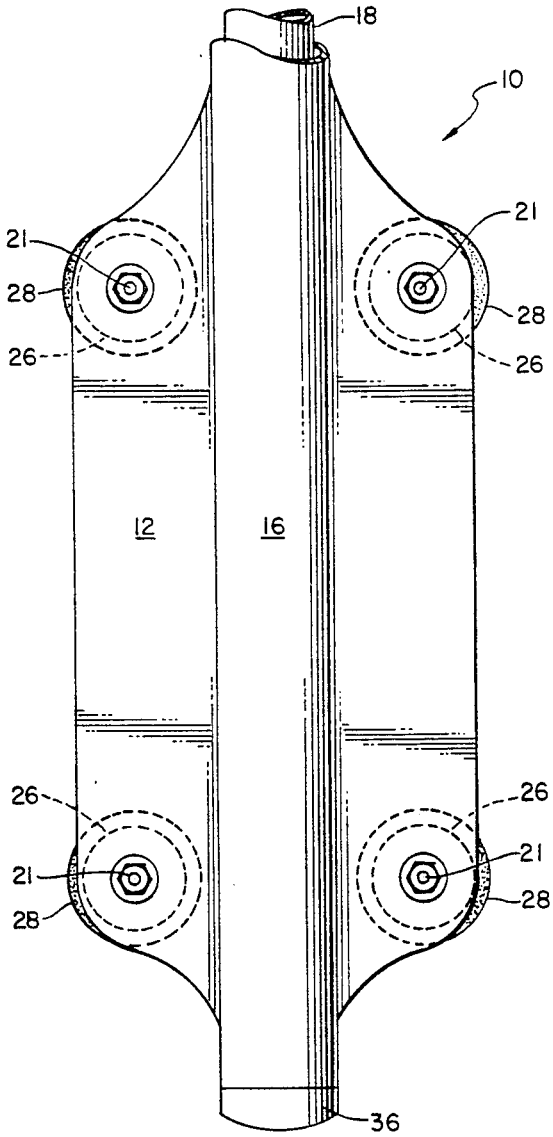
FIG. 3 is a plan view of the signalling device disclosing the guide tube in which the buoyant tube is slidably mounted.

When the skier resumes his upright position on his water skis, the water retained inside the guide tube 14 gradually drains out through opening 40 permitting the buoyant tube 18 to gently sink back into its retracted position in the guide tube 16 as shown in FIG. 2.

Having described the invention what I claim as new is:

1. A self elevating signalling device to provide a safety visual marker easily attached to a flotation jacket for persons engaged in water skiing comprising a support member adapted to be secured to the outer surface of the flotation jacket, a guide tube secured to said support member and positioned in a vertical position when the person in the water is wearing the floatation jacket, a buoyant tube with an enlarged signal head freely mounted inside the guide tube, said guide tube having an opening formed therein, said opening positioned below the surface of the water in the event the person falls into the water, enabling the guide tube to fill with water thereby causing the buoyant tube to rise inside the guide tube, the length of the buoyant tube such that the water inside the guide tube raises the buoyant tube until the signal head of the buoyant tube rises above the head of the person wearing the flotation jacket significantly increasing the person's visibility.

2. A self elevating signalling device to provide a safety visual marker for persons engaged in water sports comprising a support, a flotation jacket, said support adapted to be attached to said flotation jacket, a guide tube rigidly mounted on said support and positioned in a vertical position when the person in the water is wearing the floatation jacket, said guide tube having an open upper end, a buoyant tube with an enlarged signal head freely mounted inside the guide tube, an end cap mounted on the lower end of said guide tube, an opening formed in said end cap below the surface of the water enabling the guide tube to fill with water when the person falls into the water causing the buoyant tube to rise inside the guide tube until the enlarged signal head rises above the head of the person wearing the floatation jacket, significantly increasing the visibility of the person wearing the flotation jacket.

3. The self elevating signalling device described in claim 2 wherein said opening in said end cap is small enough to restrict water from rushing into the guide tube too fast thereby preventing a premature extension of said buoyant tube from said guide tube, thereby preventing the buoyant tube from being broken by the shock of its impact with the water.

4. The self elevating signalling device described in claim 3 wherein said guide tube has an open upper edge, a portion of said buoyant tube extending above said open upper edge, said open upper edge of said guide tube having a curved flange with a large radius of curvature to avoid sharp edges at the top of the guide tube so that if the person falls into the water, the portion of the buoyant tube extending above the upper edge of the guide tube and striking the curved flange will not break or hang up on the upper edge of the guide tube because of the absence of a sharp edge.

5. The signalling device described in claim 4 wherein said guide tube is provided with a stop collar extending inward from its inner surface, a closure secured to the base of said buoyant tube, the outside diameter of said closure greater than the inside diameter of the stop collar, whereby the closure engages the stop collar when the buoyant tube rises thereby preventing the buoyant tube from being separated from the guide tube.

6. A self elevating signalling device to provide a safety visual marker for water skiers comprising a support, a flotation jacket, said support attached to said flotation jacket, a guide tube, said guide tube having an upper end and a lower end rigidly mounted on said support and positioned in a vertical position when the water skier in the water is wearing the floatation jacket, a buoyant tube with an enlarged signal head freely mounted inside the guide tube, the upper end of said guide tube having a curved flange avoid a sharp edge thereby increasing the contact area between the guide tube and the portion of the buoyant tube striking the upper end of the guide tube so that the buoyant tube will not break or hang up on the upper end of the guide tube if the water skier falls, said curved flange serving to guide the buoyant tube back into the guide tube when the water skier is leaving the water.

7. The self elevating signalling device described in claim 6 wherein an end cap is mounted on the lower end of the guide tube, an opening formed in said end cap below the surface of the water enabling the guide tube to fill with water causing the buoyant tube to rise inside the guide tube until the enlarged signal head rises above the head of the water skier wearing the floatation jacket, significantly increasing the visibility of the water skier in the water.

* * * * *